US010112285B2

(12) United States Patent
Fujiya et al.

(10) Patent No.: US 10,112,285 B2
(45) Date of Patent: Oct. 30, 2018

(54) GRINDING WHEEL AND GRINDING METHOD

(71) Applicant: DISCO CORPORATION, Tokyo (JP)

(72) Inventors: Ryoko Fujiya, Tokyo (JP); Yoshiyasu Nakagawa, Tokyo (JP)

(73) Assignee: Disco Corporation, Tokyo (JP)

( * ) Notice: Subject to any disclaimer, the term of this patent is extended or adjusted under 35 U.S.C. 154(b) by 23 days.

(21) Appl. No.: 15/267,703

(22) Filed: Sep. 16, 2016

(65) Prior Publication Data

US 2017/0080547 A1 Mar. 23, 2017

(30) Foreign Application Priority Data

Sep. 17, 2015 (JP) ..... 2015-183865

(51) Int. Cl.

| | |
|---|---|
| ***B24D 7/06*** | (2006.01) |
| ***B24D 7/10*** | (2006.01) |
| ***B24B 55/02*** | (2006.01) |
| ***B24B 7/02*** | (2006.01) |
| ***B24B 7/04*** | (2006.01) |

(52) U.S. Cl.

CPC ..... *B24D 7/06* (2013.01); *B24B 7/02* (2013.01); *B24B 7/04* (2013.01); *B24B 55/02* (2013.01); *B24D 7/10* (2013.01)

(58) Field of Classification Search

CPC .. B24B 7/02; B24B 7/04; B24B 55/02; B24D 7/06; B24D 7/10

USPC ..... 451/541, 542, 548

See application file for complete search history.

(56) References Cited

U.S. PATENT DOCUMENTS

| | | | | | |
|---|---|---|---|---|---|
| 1,611,352 | A * | 12/1926 | Larsson | B24D 7/066 | 451/548 |
| RE25,410 | E * | 7/1963 | Wayland | B24D 7/06 | 125/3 |
| 3,181,281 | A * | 5/1965 | Hensley | B24D 7/06 | 125/3 |
| 3,793,783 | A * | 2/1974 | Paterno, Jr. | B24D 5/123 | 451/543 |
| 9,138,855 | B2 * | 9/2015 | Kang | B24B 27/0076 | |
| 2012/0142260 | A1 * | 6/2012 | Gosamo | B24D 7/06 | 451/548 |
| 2016/0256982 | A1 * | 9/2016 | Mejean | B24D 7/06 | |

FOREIGN PATENT DOCUMENTS

JP 2000-173954 6/2000

* cited by examiner

*Primary Examiner* — Eileen Morgan

(74) *Attorney, Agent, or Firm* — Greer Burns & Crain Ltd.

(57) ABSTRACT

Disclosed herein is a grinding wheel including a wheel base to be fixed to a spindle, a plurality of abrasive members fixed to the wheel base, and a plurality of grinding water supply holes for supplying a grinding water to the abrasive members. Each abrasive member is formed as a segment abrasive having an outer surface extending downward from the lower surface of the wheel base so as to be inclined radially outward. The plural abrasive members are arranged annularly at given intervals. The plural grinding water supply holes are formed on the lower surface of the wheel base in the vicinity of the abrasive members so as to each correspond to the abrasive members in the condition where each grinding water supply hole lies on a line connecting the corresponding abrasive member and the axis of rotation of the wheel base.

2 Claims, 9 Drawing Sheets

GRINDING WHEEL AND GRINDING METHOD

BACKGROUND OF THE INVENTION

Field of the Invention

The present invention relates to a grinding wheel for grinding a workpiece such as a resin substrate and also to a grinding method using the grinding wheel.

Description of the Related Art

Usually, a tough material such as resin and metal is subjected to cutting such as flattening and thinning in a tool cutting apparatus (see Japanese Patent Laid-open No. 2000-173954, for example). The tool cutting apparatus described in Japanese Patent Laid-open No. 2000-173954 includes a spindle adapted to be rotated about a vertical axis, a mount fixed to the lower end of the spindle, a wheel base mounted on the lower surface of the mount, and a cutting tool such as a diamond tool and a cemented carbide tool fixed to a part of the lower surface of the wheel base at an outer circumferential portion thereof, wherein the wheel base and the cutting tool constitute a grinding wheel. Accordingly, the cutting tool having an acute cutting edge is rotated about the axis of the spindle to cut the upper surface of a workpiece formed of a tough material held on a chuck table, thereby flattening or thinning the workpiece.

SUMMARY OF THE INVENTION

In the grinding wheel of the tool cutting apparatus described in Japanese Patent Laid-open No. 2000-173954, the shape of the acute cutting edge of the cutting tool is gradually changed with an increase in number of workpieces, causing a degradation in grinding quality. Accordingly, the shape of the cutting tool must be corrected periodically. However, special processing such as electrical discharge processing is required for the shape correction of the cutting tool such as a diamond tool and a cemented carbide tool, so that there is a problem such that any separate equipment dedicated to the shape correction is required and much time is also required for the shape correction.

It is therefore an object of the present invention to provide a grinding wheel and a grinding method which can correct the shape of an abrasive member used as a cutting edge easily in a short period of time.

In accordance with an aspect of the present invention, there is provided a grinding wheel for grinding a resin substrate, including a wheel base having a free end portion and a fixed portion to be fixed to a spindle; and a plurality of abrasive members fixed to the free end portion of the wheel base; the wheel base having a plurality of grinding water supply holes for supplying a grinding water to the abrasive members; each abrasive member being formed as a segment abrasive obtained by binding diamond abrasive grains with a metal bond; the shape of each abrasive member being set so that each abrasive member has an outer surface extending downward from the free end portion of the wheel base so as to be inclined radially outward of the wheel base; the plurality of abrasive members being arranged annularly at given intervals; the plurality of grinding water supply holes being formed on the free end portion of the wheel base in the vicinity of the abrasive members so as to each correspond to the abrasive members in the condition where each grinding water supply hole lies on a line connecting the corresponding abrasive member and the axis of rotation of the wheel base.

With this configuration, the angle formed by the outer surface of each abrasive member with respect to the upper surface (work surface) of the resin substrate is set as an acute angle, so that each abrasive member is used like a cutting edge. The inclined outer surface of each abrasive member acts on the resin substrate in grinding the resin substrate, so that the resin substrate can be well thinned. At this time, the resin substrate is continuously ground by using the plural abrasive members, so that a fine grinding dust is produced and it does not deposited in a grinding apparatus, thereby avoiding drainage trouble. Further, even when the shape of each abrasive member becomes worse during grinding, the shape of each abrasive member can be corrected by a dresser board. Accordingly, it is not necessary to newly provide any equipment for shape correction of each abrasive member, but the shape of each abrasive member can be easily corrected in a short period of time, thereby attaining good economy. Further, since a grinding water is supplied from the plural grinding water supply holes to the plural abrasive members each corresponding thereto, a frictional heat generated from each abrasive member during grinding can be effectively removed.

In accordance with another aspect of the present invention, there is provided a grinding method of grinding a tough substrate by using a grinding apparatus including a chuck table for holding the tough substrate, grinding means having a rotating spindle and a grinding wheel fixed to the rotating spindle for grinding the tough substrate held on the chuck table, abrasive feeding means for relatively moving the grinding means and the chuck table toward and away from each other in an abrasive feeding direction, and moving means for relatively moving the grinding means and the chuck table in a radial direction of the chuck table; the grinding wheel including a wheel base having a free end portion and a fixed portion fixed to the rotating spindle; and a plurality of abrasive members fixed to the free end portion of the wheel base; the wheel base having a plurality of grinding water supply holes for supplying a grinding water to the abrasive members; each abrasive member being formed as a segment abrasive obtained by binding diamond abrasive grains with a metal bond; the shape of each abrasive member being set so that each abrasive member has an outer surface extending downward from the free end portion of the wheel base so as to be inclined radially outward of the wheel base; the plurality of abrasive members being arranged annularly at given intervals; the plurality of grinding water supply holes being formed on the free end portion of the wheel base in the vicinity of the abrasive members so as to each correspond to the abrasive members in the condition where each grinding water supply hole lies on a line connecting the corresponding abrasive member and the axis of rotation of the wheel base; the grinding method including grinding the tough substrate held on the chuck table by creep feed grinding such that the grinding wheel being rotated is horizontally moved relative to the tough substrate.

With this configuration, the tough substrate is ground by the plural abrasive members each having the inclined outer surface, so that a large grinding dust is not produced in grinding the tough substrate, so that the tough substrate can be well thinned. Further, when the shape of each abrasive member is changed during grinding the tough substrate, the shape of each abrasive member can be easily corrected in a short period of time. Further, since a grinding water is supplied from the plural grinding water supply holes to the plural abrasive members, a frictional heat generated from each abrasive member can be effectively removed.

The above and other objects, features and advantages of the present invention and the manner of realizing them will become more apparent, and the invention itself will best be understood from a study of the following description and appended claims with reference to the attached drawings showing a preferred embodiment of the invention.

DETAILED DESCRIPTION OF THE PREFERRED EMBODIMENT

Figure 1:
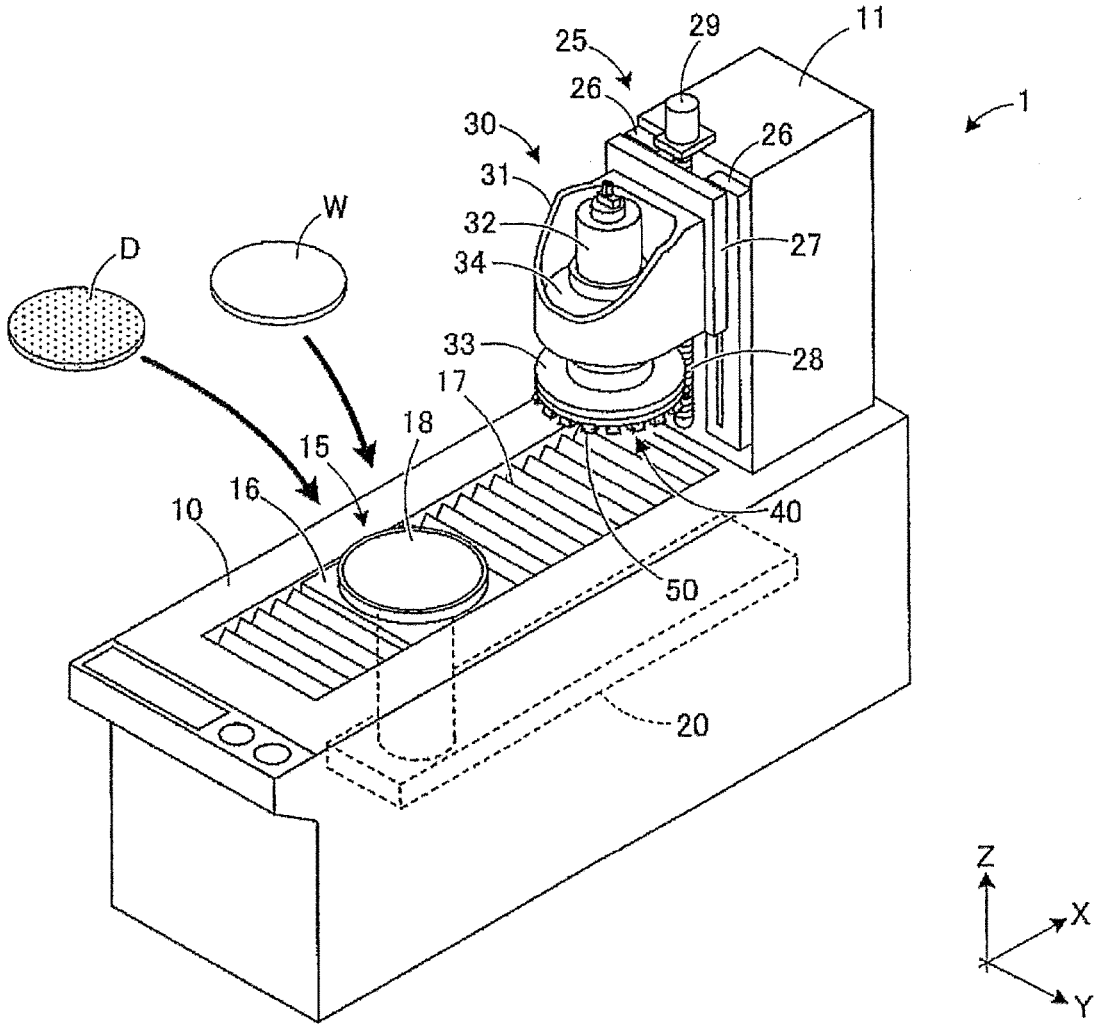
FIG. 1 is a perspective view of a grinding apparatus according to a preferred embodiment of the present invention.
Figure 2:
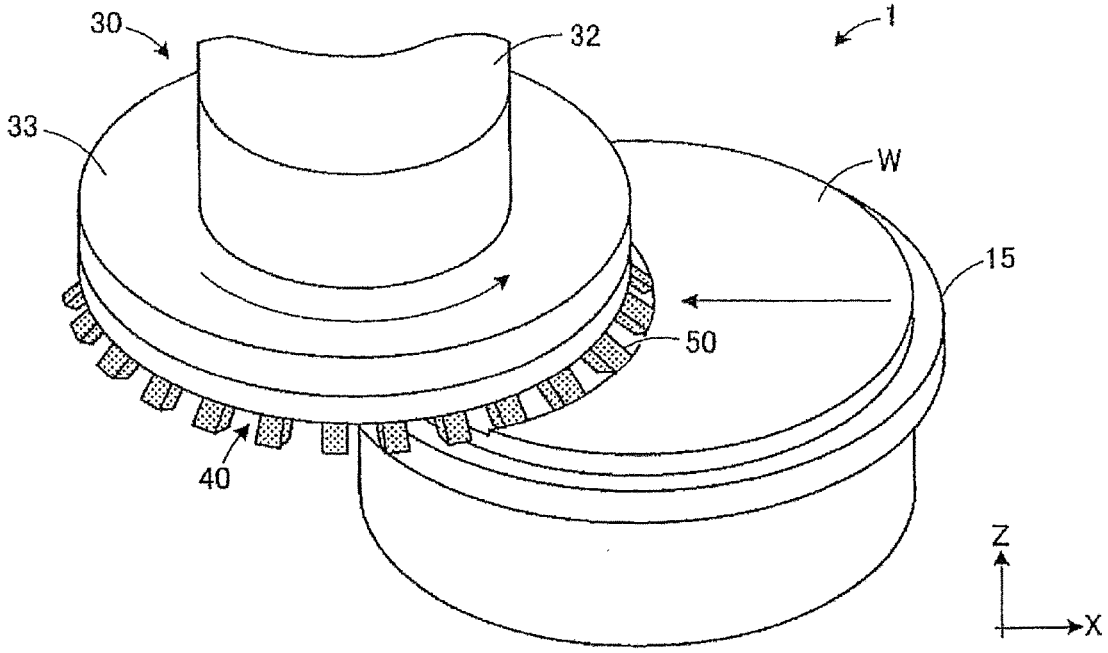
FIG. 2 is a perspective view showing a grinding operation by the grinding apparatus shown in FIG. 1.

A grinding apparatus according to a preferred embodiment of the present invention will now be described with reference to the attached drawings. FIG. 1 is a perspective view of a grinding apparatus 1 according to a preferred embodiment. FIG. 2 is a perspective view showing a grinding operation by the grinding apparatus 1. The configuration of the grinding apparatus according to this preferred embodiment is not limited to a configuration dedicated to grinding as shown in FIG. 1, but may be incorporated in a full-automatic type processing apparatus adapted to fully automatically perform a series of processing including grinding, polishing, and cleaning.

As shown in FIG. 1, the grinding apparatus 1 includes a chuck table 15 for holding a resin substrate W and a grinding wheel 40 having a plurality of abrasive members 50 for grinding the resin substrate W held on the chuck table 15, wherein creep feed grinding is performed to the upper surface of the resin substrate W by the abrasive members 50 of the grinding wheel 40 being rotated as feeding the chuck table 15 at a low speed in the X direction shown by an arrow X in FIG. 1. Further, a dresser board D for dressing (inclusive of truing) the abrasive members 50 is adapted to be periodically held on the chuck table 15 in place of the resin substrate W, wherein creep feed grinding is performed to the upper surface of the dresser board D by the abrasive members 50, thereby dressing the abrasive members 50. While the resin substrate W is used as a workpiece in this preferred embodiment, the workpiece may be a tough substrate formed of any tough material such as resin and metal.

The grinding apparatus 1 includes a base housing 10 having an upper surface. The upper surface of the base housing 10 is formed with a rectangular opening extending in the X direction. This rectangular opening is closed by a movable plate 16 and a bellows-like waterproof cover 17, wherein the movable plate 16 is movable with the chuck table 15 in the X direction, and the waterproof cover 17 is mounted on opposite sides of the movable plate 16 in the X direction so as to be expanded and contracted in the X direction by the movement of the movable plate 16. Ball screw type moving means 20 for moving the chuck table 15 in its radial direction (X direction) is provided below the waterproof cover 17. The chuck table 15 has an upper surface as a holding surface 18 for holding the resin substrate W under suction. The holding surface 18 is formed of a porous material. The holding surface 18 is connected through a suction passage (not shown) formed in the chuck table 15 to a vacuum source (not shown), so that a vacuum is produced on the holding surface 18 to thereby hold the resin substrate W on the holding surface 18 under suction.

A vertically extending column 11 is provided on the base housing 10 at its rear portion. Abrasive feeding means 25 is provided on the front side of the column 11. The abrasive feeding means 25 functions to move grinding means 30 toward and away from the chuck table 15 in an abrasive feeding direction (Z direction shown by an arrow Z in FIG. 1). The abrasive feeding means 25 has a pair of parallel guide rails 26 provided on the column 11 so as to extend in the Z direction and a motor-driven Z table 27 slidably mounted on the guide rails 26. A nut portion (not shown) is formed on the back side of the Z table 27, and a ball screw 28 is threadedly engaged with this nut portion. A drive motor 29 is connected to one end of the ball screw 28, thereby rotationally driving the ball screw 28. Accordingly, when the ball screw 28 is rotated by operating the drive motor 29, the Z table 27 is moved in the Z direction along the guide rails 26. The grinding means 30 is supported to the Z table 27 so as to be movable with the Z table 27 in the Z direction.

The grinding means 30 includes a housing 31 mounted on the front surface of the Z table 27, a cylindrical spindle 32 rotatably supported through a flange 34 to the housing 31, and a mount 33 fixed to the lower end of the spindle 32. The grinding means 30 further includes the grinding wheel 40 mounted on the lower surface of the mount 33. The grinding wheel 40 includes the plurality of abrasive members 50 arranged annularly at given intervals. Each abrasive member 50 is a segment abrasive formed by binding diamond abrasive grains with a metal bond. The detailed configuration of the grinding wheel 40 and the abrasive members 50 will be hereinafter described.

As shown in FIG. 2, the grinding apparatus 1 is operated in the following manner. The grinding wheel 40 is rotated about its axis extending in the Z direction by rotating the spindle 32, and the grinding means 30 is moved toward the chuck table 15 previously set below the grinding means 30. A grinding water is supplied to the resin substrate W held on the chuck table 15, and the abrasive members 50 of the grinding wheel 40 being rotated comes into contact with the resin substrate W, so that each abrasive member 50 slides on the upper surface of the resin substrate W, thereby grinding the upper surface of the resin substrate W. In the condition where the resin substrate W is ground by the abrasive members 50, the chuck table 15 is horizontally moved in the X direction at a low speed to thereby perform creep feed grinding of the resin substrate W by the abrasive members 50.

In general, the resin substrate W formed of a tough material is preferably cut by a cutting tool such as a diamond tool and a cemented carbide tool. However, when the cutting tool is worn, much time and dedicated equipment are required for shape correction of the cutting tool. To cope with this problem, each abrasive member 50 of the grinding wheel 40 according to this preferred embodiment has a cutting edge like a cutting tool, thereby facilitating the thinning of the resin substrate W by the abrasive members 50. Further, in the case that the abrasive members 50 are worn, the dresser board D (see FIG. 1) is held on the chuck table 15 in place of the resin substrate W to thereby allow shape correction of the abrasive members 50 in the grinding apparatus 1.

In the case of cutting the resin substrate W by using a single cutting tool in a conventional tool cutting apparatus, the resin substrate W is cut by the single cutting tool fixed to the lower surface of a mount, so that a cutting dust becomes a sheet-like dust to cause a possibility of drainage trouble. To cope with this problem, the grinding wheel 40 according to this preferred embodiment has the plural abrasive members 50 to thereby continuously grind the resin substrate W, so that a powder-like grinding dust can be produced. Further, the grinding wheel 40 according to this preferred embodiment includes a plurality of grinding water supply holes 46 (see FIG. 3B) for supplying a grinding water to the abrasive members 50, the plural grinding water supply holes 46 being positioned so as to each correspond to the plural abrasive members 50, thereby effectively removing a frictional heat generated from the abrasive members 50 in grinding the resin substrate W.

Figure 3A:
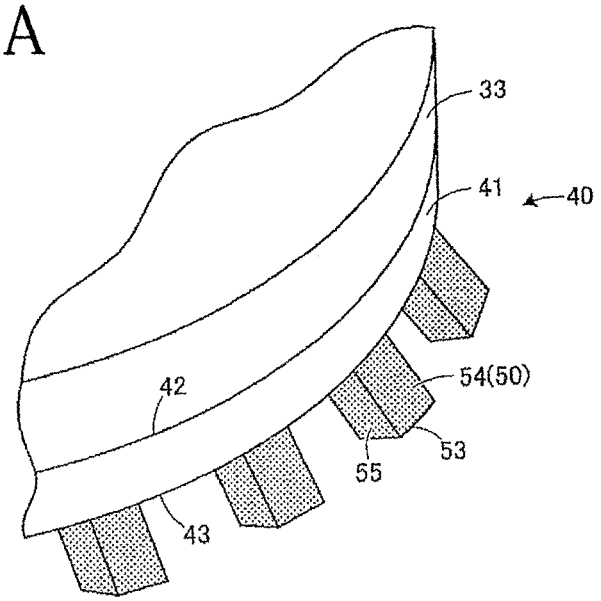
FIGS. 3A and 3B are perspective views of an essential part of a grinding wheel included in the grinding apparatus shown in FIG. 1.

The grinding wheel 40 according to this preferred embodiment will now be described in more detail with reference to FIGS. 3A and 3B. FIG. 4 is a perspective view of a grinding wheel 60 as a comparison. FIG. 3A is a perspective view of the grinding wheel 40 as viewed from the upper side thereof, and FIG. 3B is a perspective view of the grinding wheel 40 as viewed from the lower side thereof.

As shown in FIG. 3A, the grinding wheel 40 is composed of a ring-like wheel base 41 and the plural abrasive members 50 mounted on the lower surface of the wheel base 41. The upper surface of the wheel base 41 functions as a fixed portion 42 fixed through the mount 33 to the spindle 32 (see FIG. 2), and the lower surface of the wheel base 41 is a free end portion 43. The plural abrasive members 50 are mounted on the free end portion 43 so as to be arranged annularly at given intervals. Each abrasive member 50 is formed as a segment abrasive having a parallelogram shape as viewed in side elevation. That is, each abrasive member 50 has an outer surface 54 extending downward from the free end portion 43 (lower surface) of the wheel base 41 so as to be inclined radially outward of the wheel base 41, i.e., so as to project radially outward from the side surface (outer circumferential surface) of the wheel base 41.

As described above, each abrasive member 50 is formed by binding (sintering) diamond abrasive grains with a metal bond. Each abrasive member 50 thus formed has a high hardness, so that even when each abrasive member 50 is used like a cutting tool in grinding the resin substrate W, the shape of each abrasive member 50 can be easily maintained. Further, like general abrasive members of a grinding wheel, the shape of each abrasive member 50 can be corrected by using the dresser board D (see FIG. 1) held on the chuck table 15 (see FIG. 1). While each abrasive member 50 is formed by binding diamond abrasive grains with a metal bond in this preferred embodiment, each abrasive member 50 may be formed by binding any other abrasive grains with any other bond such as a resin bond and a vitrified bond, provided that the shape of each abrasive member 50 can be maintained during grinding.

Figure 3B:
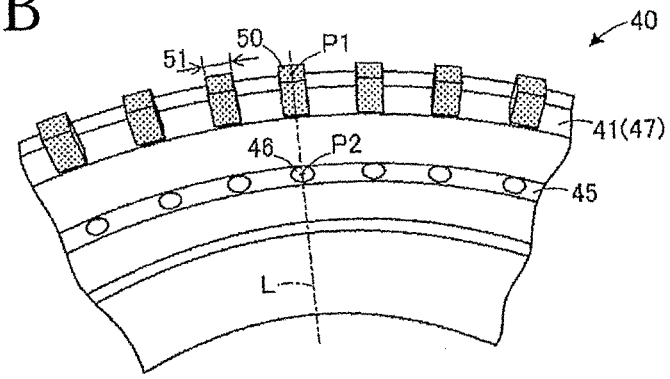
Figure 4:
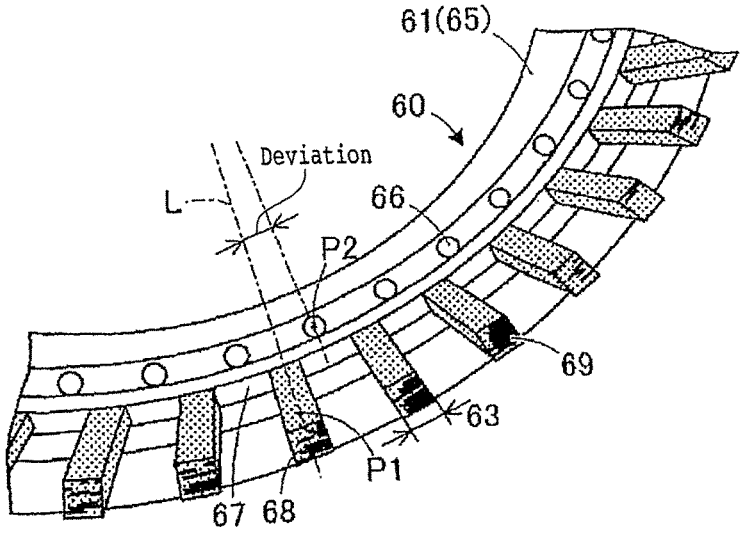
FIG. 4 is a perspective view of an essential part of a grinding wheel as a comparison.

As shown in FIG. 3B, the plural abrasive members 50 are mounted on the lower surface of the wheel base 41 so as to be arranged annular along the outer circumference of the wheel base 41 at given intervals. Each abrasive member 50 has a width 51 smaller than that of a general abrasive member. For example, the width 51 of each abrasive member 50 is set smaller than the spacing between the adjacent abrasive members 50. Accordingly, the contact area between each abrasive member 50 and the resin substrate W (see FIG. 1) can be reduced to thereby reduce a frictional heat and facilitate the cooling with a grinding water. Further, since the width 51 of each abrasive member 50 is small, the abrasive members 50 to be arranged on the wheel base 41 can be increased in number. By grinding the resin substrate W with the increased number of abrasive members 50, the grinding dust of the resin substrate W can be made fine.

The wheel base 41 has a radially inside lower surface 45 and a radially outside lower surface 47. The plural grinding water supply holes 46 are formed on the radially inside lower surface 45 of the wheel base 41 so as to be positioned in the vicinity of the plural abrasive members 50 in such a manner that each grinding water supply hole 46 lies on a line L connecting the corresponding abrasive member 50 and the axis of rotation of the grinding wheel 40. More specifically, P1 shown in FIG. 3B denotes the center of the width of each abrasive member 50 fixed to the radially outside lower surface 47 of the wheel base 41, and P2 shown in FIG. 3B denotes the center of each grinding water supply hole 46 formed on the radially inside lower surface 45 of the wheel base 41. The center P1 of each abrasive member 50 and the center P2 of the corresponding grinding water supply hole 46 lies on the line L extending radially from the axis of rotation of the grinding wheel 40. With this arrangement, the grinding water supplied from each grinding water supply hole 46 is directed radially outward toward the corresponding abrasive member 50 by a centrifugal force produced in grinding, thereby allowing good cooling of the abrasive members 50.

In contrast, the grinding wheel 60 as a comparison shown in FIG. 4 is different from the grinding wheel 40 shown in FIG. 3B in the position of the grinding water supply holes. That is, the grinding wheel 60 is composed of an annular wheel base 61 and a plurality of abrasive members 68 mounted on the lower surface of the wheel base 61 so as to be arranged annularly at given intervals. The wheel base 61 has a radially inside lower surface 65 and a radially outside lower surface 67. A plurality of grinding water supply holes 66 are formed on the radially inside lower surface 65 of the wheel base 61 so as to be deviated from a line L connecting each abrasive member 68 and the axis of rotation of the grinding wheel 60. The plural abrasive members 68 are fixed to the radially outside lower surface 67 of the wheel base 61. More specifically, P1 shown in FIG. 4 denotes the center of the width of each abrasive member 68, and P2 shown in FIG. 4 denotes the center of each grinding water supply hole 66, wherein the center P1 of each abrasive member 68 and the center P2 of each grinding water supply hole 66 in the vicinity thereof are deviated from each other in the circumferential direction of the grinding wheel 60. Accordingly, the grinding water supplied from each grinding water supply hole 66 is directed radially outward to pass between the adjacent abrasive members 68 by a centrifugal force produced in grinding, so that the grinding water is not enough supplied to the abrasive members 68 to cause poor cooling of the abrasive members 68.

If the resin substrate W continues to be ground by using the grinding wheel 60 as a comparison, a part of the resin substrate W may be melted by the frictional heat generated in grinding and a resultant melted resin 69 may stick to the abrasive members 68. In this case, the melted resin 69 sticking to the abrasive members 68 has an adverse effect in grinding the resin substrate W, causing a degradation in appearance of the resin substrate W after grinding. In this manner, even when the width 63 of each abrasive member 68 is small in the case of grinding the resin substrate W by using the increased number of abrasive members 68, the abrasive members 68 cannot be enough cooled by the grinding water in the arrangement that each grinding water supply hole 66 does not lie on the line L connecting each abrasive member 68 and the axis of rotation of the grinding wheel 60 as shown in FIG. 4.

The present inventor tested to modify the grinding wheel 40 in such a manner that the grinding water supply holes 46 each correspond to alternate ones of the plural abrasive members 50. When the resin substrate W was ground by using such a modified grinding wheel 40, the adhesion of a melted resin to the abrasive members 50 was not observed. This is considered to be due to the fact that the grinding water supplied from each grinding water supply hole 46 strikes the corresponding abrasive member 50 and then changes the flow direction of the grinding water toward the next abrasive member 50 adjacent to the above corresponding abrasive member 50. Accordingly, the plural grinding water supply holes 46 are not each necessarily required to correspond to the plural abrasive members 50, provided that each grinding water supply hole 46 is so formed in the vicinity of the abrasive members 50 as to lie on the line L connecting the corresponding abrasive member 50 and the axis of rotation of the grinding wheel 40.

Figure 5A:
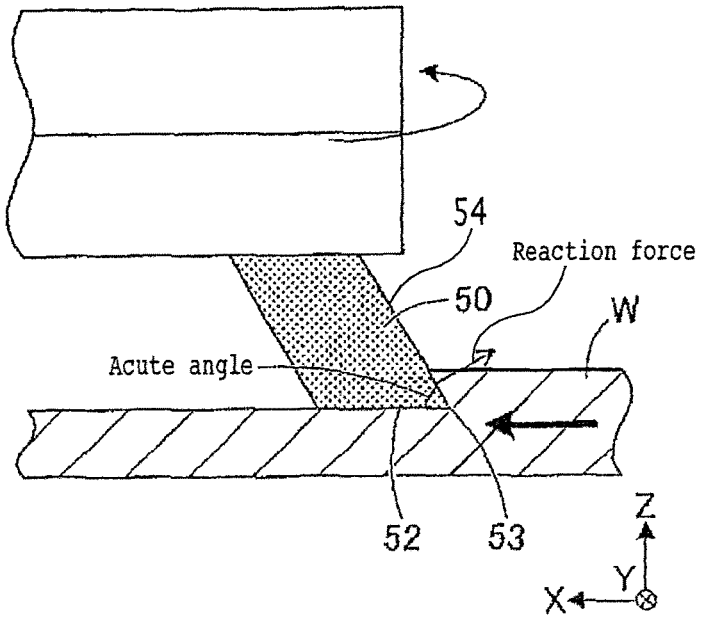
FIG. 5A is a sectional view for illustrating a grinding operation by abrasive members according to this preferred embodiment.
Figure 5B:
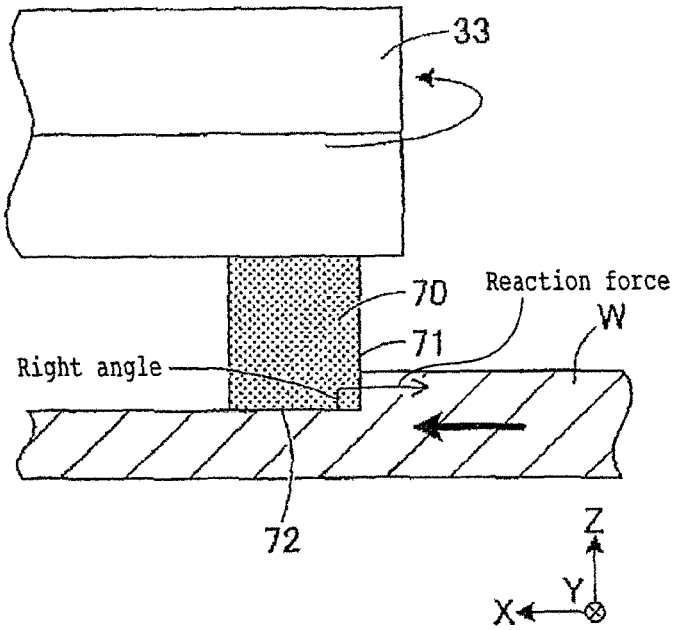
FIG. 5B is a view similar to FIG. 5A, showing a comparison.
Figure 6:
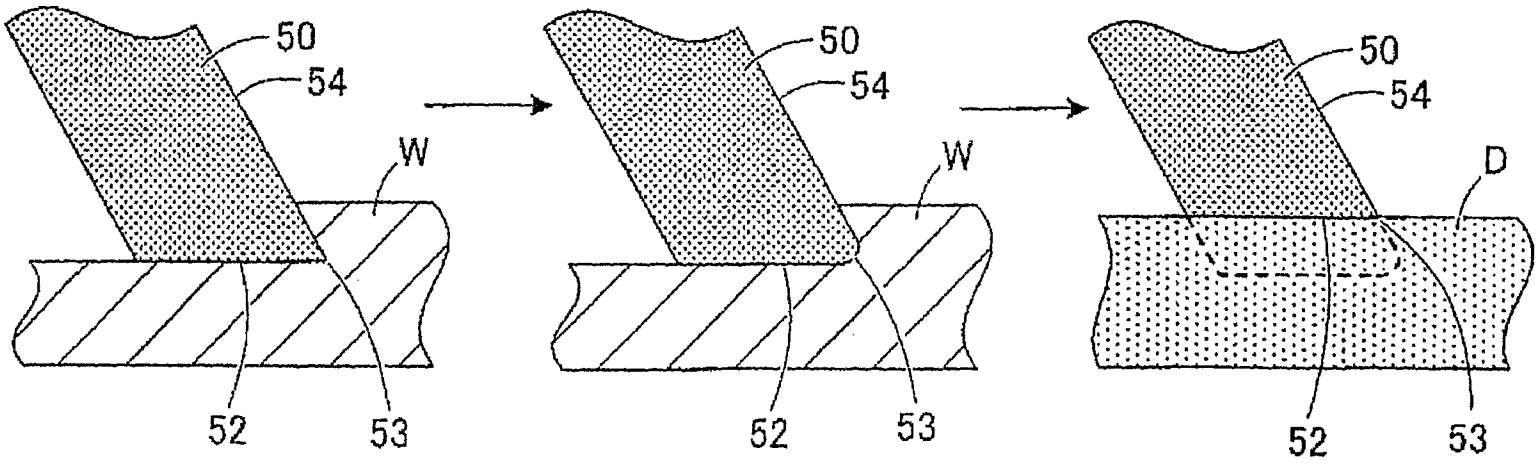
FIG. 6 is a sectional view for illustrating a change in shape of each abrasive member according to this preferred embodiment.
Figure 7A:
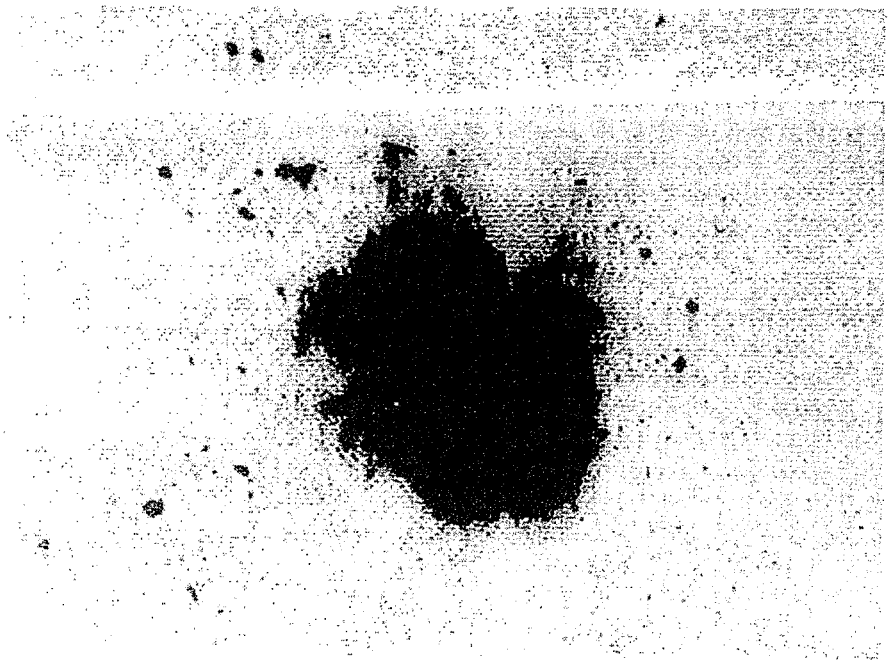
FIGS. 7A and 7B are photographs showing a grinding dust produced in grinding a resin substrate.
Figure 7B:
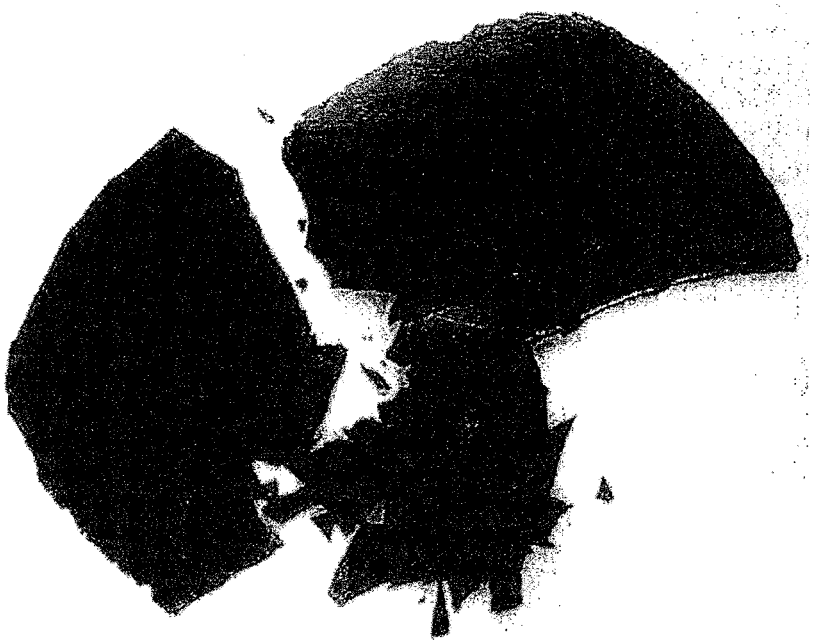

A grinding operation using the grinding wheel 40 according to this preferred embodiment will now be described with reference to FIGS. 5A to 7B. FIGS. 5A and 5B are sectional views for illustrating the grinding operation according to this preferred embodiment. FIG. 6 is a sectional view for illustrating a change in shape of each abrasive member according to this preferred embodiment. FIGS. 7A and 7B are photographs showing a grinding dust produced in grinding the resin substrate W. More specifically, FIG. 5A shows the grinding operation using the grinding wheel 40 according to this preferred embodiment, and FIG. 5B shows the grinding operation using a grinding wheel as a comparison. FIG. 7A shows the grinding dust in the case of using a plurality of abrasive members, and FIG. 7B shows the grinding dust in the case of using a single abrasive member.

As shown in FIG. 5A, each abrasive member 50 has an outer surface 54 and a bottom surface 52, wherein an angular portion 53 is formed by the outer surface 54 and the bottom surface 52 so that the angle between the outer surface 54 and the upper surface of the resin substrate W (i.e., the bottom surface 52) is an acute angle. In the creep feed grinding, each abrasive member 50 is rotated about the axis of rotation of the spindle 32 (see FIG. 2), and the chuck table 15 (see FIG. 1) holding the resin substrate W is horizontally moved in the X direction relative to the abrasive members 50. Each abrasive member 50 further has a side surface 55 (see FIG. 3A) on the leading side of the rotational direction of each abrasive member 50. The upper surface of the resin substrate W is ground by this leading side surface 55 and the outer surface 54 of each abrasive member 50 in the circumferential direction of the grinding wheel 40 (in the direction toward the back side of the sheet plane of FIG. 5A). At the same time, the resin substrate W is fed in the X direction (in the direction toward the left side as viewed in FIG. 5A).

Since the outer surface 54 of each abrasive member 50 is inclined as shown in FIG. 5A, a grinding resistance to each abrasive member 50 in grinding the resin substrate W can be reduced. That is, a reaction force acts in a direction perpendicular to the inclined outer surface 54, so that the horizontal component of the reaction force (the component in the X direction) can be reduced. Accordingly, the friction to the upper surface (work surface) of the resin substrate W after grinding can be reduced to thereby suppress blushing of the work surface and obtain good appearance. Thus, the outer surface 54 is inclined at an acute angle with respect to the bottom surface 52 of each abrasive member 50 according to this preferred embodiment. Accordingly, each abrasive member 50 can be used like a cutting tool to thereby well grind the resin substrate W.

In contrast, the grinding wheel as a comparison shown in FIG. 5B has a plurality of abrasive members 70 each having a rectangular shape as viewed in side elevation. That is, each abrasive member 70 has an outer surface 71 and a bottom surface 72, wherein the angle formed between the outer surface 71 and the bottom surface 72 is a right angle rather than an acute angle unlike each abrasive member 50 shown in FIG. 5A. Accordingly, in the case of using the abrasive members 70 as a comparison, a large reaction force acts in a direction perpendicular to the vertical outer surface 71, i.e., in a horizontal direction (X direction), so that a grinding resistance to each abrasive member 70 in grinding the resin substrate W is large. As a result, the work surface of the resin substrate W after grinding undergoes partial blushing due to friction, so that variations in density on the work surface becomes remarkable to cause poor appearance. Thus, each abrasive member 70 as a comparison cannot well grind the resin substrate W.

Further, as also shown at the left position in FIG. 6, the angular portion 53 formed between the outer surface 54 and the bottom surface 52 of each abrasive member 50 has an acute angle. The angular portion 53 of each abrasive member 50 contributes to grinding of the resin substrate W, so that as shown at the central position in FIG. 6, the shape of each abrasive member 50 changes with the elapse of time due to wearing. That is, the edge (ridge line) of the angular portion 53 is lost to become round. In this case, the resin substrate W is replaced by the dresser board D as shown at the right position in FIG. 6 to perform creep feed grinding of the dresser board D by the use of each abrasive member 50. As a result, the bottom surface 52 of each abrasive member 50 is dressed. Accordingly, the angular portion 53 between the outer surface 54 and the bottom surface 52 is sharpened to restore an acute angle, that is, the shape of each abrasive member 50 is corrected.

According to this preferred embodiment, all of the abrasive members 50 constituting the grinding wheel 40 (see FIG. 3A) are dressed at a time by the dresser board D. Accordingly, any special equipment as in the case of correcting the shape of a cutting tool is not required and the shape of each abrasive member 50 can therefore be corrected in a short period of time. The dresser board D is formed to have a disk shape by binding abrasive grains such as green carbide (GC) and white alundum (WA) with a bond such as a resin bond. By making each abrasive member 50 cut in the dresser board D, each abrasive member 50 is dressed (inclusive of truing). Further, the dresser board D has substantially the same diameter as that of the resin substrate W in order to facilitate holding of the dresser board D on the chuck table 15 (see FIG. 1).

The grinding dust of the resin substrate W will now be described. As shown in FIG. 7A, a powder-like grinding dust was observed in the case that the resin substrate W was ground by the grinding wheel 40 (see FIG. 3A) having the plural abrasive members 50 (see FIG. 3A) by the present inventor. This result is considered to be due to the fact that the resin substrate W was continuously ground by the plural abrasive members 50. Accordingly, the grinding apparatus 1 (see FIG. 1) is not clogged with the powder-like grinding dust, thereby preventing drainage trouble. In contrast, as shown in FIG. 7B, a sheet-like grinding dust was observed in the case that the resin substrate W was ground by a grinding wheel (not shown) having a single abrasive member 50 as a comparison. Thusly, the grinding dust can be made fine by using the plural abrasive members 50 in grinding the resin substrate W.

Figure 8A:
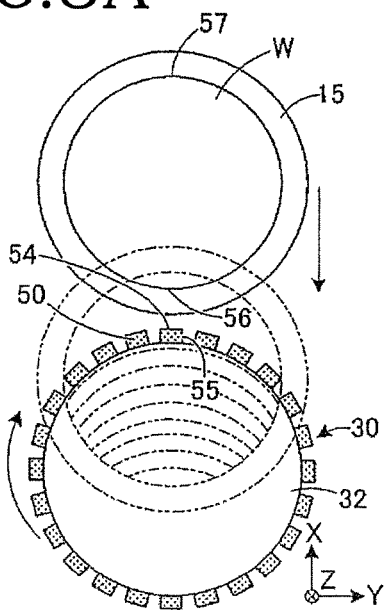
FIGS. 8A and 8B are views for illustrating a grinding operation according to this preferred embodiment.
Figure 8B:
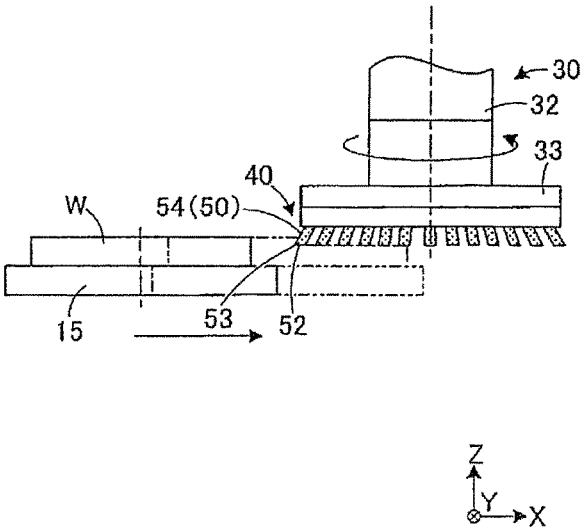
Figure 8C:
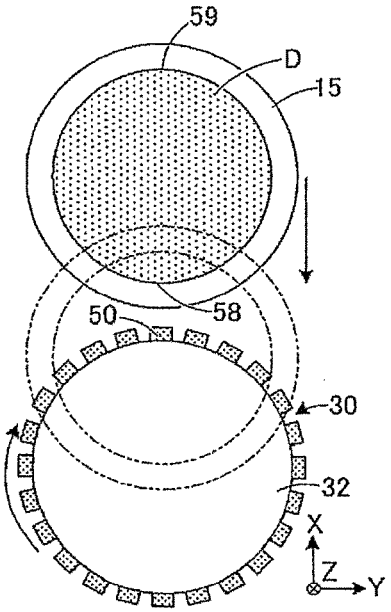
FIGS. 8C and 8D are views for illustrating a dressing operation according to this preferred embodiment.
Figure 8D:
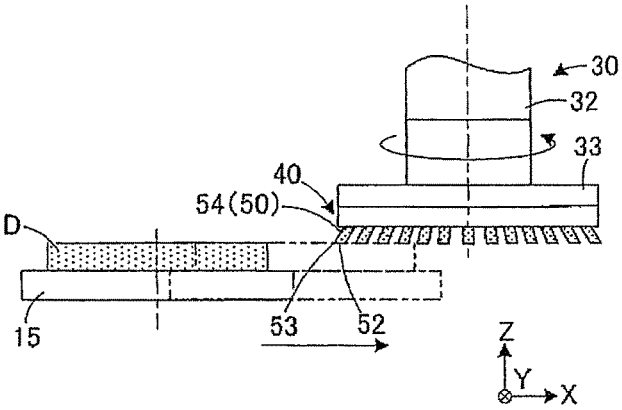

The grinding operation and the dressing operation according to this preferred embodiment will now be described with reference to FIGS. 8A to 8D. FIGS. 8A and 8B show the grinding operation to the resin substrate W, and FIGS. 8C and 8D show the dressing operation to the abrasive members 50. The grinding operation and the dressing operation shown in FIGS. 8A to 8D are merely illustrative and they may be suitably modified.

As shown in FIG. 8A, the resin substrate W is held on the chuck table 15 in a coaxial fashion, and the abrasive members 50 are previously positioned outside of the outer circumference of the resin substrate W. The abrasive members 50 are rotated about the axis of rotation of the spindle 32 at a high speed and then lowered to a predetermined depth of cut. In this condition, the chuck table 15 is horizontally moved in the X direction relative to the abrasive members 50. Accordingly, the creep feed grinding by the plural abrasive members 50 is started from one end 56 of the resin substrate W toward the other end 57 thereof in the radial direction (X direction). In the creep feed grinding, the chuck table 15 holding the resin substrate W is fed in the X direction, and at the same time the abrasive members 50 are rotated to grind the resin substrate W in such a manner that the upper surface of the resin substrate W is arcuately cut by the leading side surface 55 and the outer surface 54 of each abrasive member 50.

At this time, as shown in FIG. 8B, the angular portion 53 of each abrasive member 50 can easily penetrate in the resin substrate W in feeding the resin substrate W in the X direction because the outer surface 54 of each abrasive member 50 is inclined at an acute angle with respect to the bottom surface 52. Accordingly, a grinding resistance to each abrasive member 50 in grinding the resin substrate W can be reduced, thereby eliminating the possibility that variations in density may appear on the work surface of the resin substrate W after grinding to cause poor appearance. Further, since the resin substrate W is ground by the plural abrasive members 50, the grinding dust becomes a powder-like dust, thereby eliminating the possibility that the grinding dust may be deposited at a drain hole formed in the grinding apparatus. Further, as shown in FIG. 3B, the plural grinding water supply holes 46 are formed so as to each correspond to the plural abrasive members 50, so that a frictional heat by each abrasive member 50 during grinding can be suppressed.

As shown in FIG. 8C, the dresser board D is held on the chuck table 15 in place of the resin substrate W in the case that the angular portion 53 (see FIG. 8D) of each abrasive member 50 is worn by the creep feed grinding of the resin substrate W. As in the grinding operation to the resin substrate W, creep feed grinding is performed to the dresser board D by the abrasive members 50. That is, the creep feed grinding is started from one end 58 of the dresser board D toward the other end 59 thereof in the radial direction (X direction). In this creep feed grinding, the plural abrasive members 50 being rotated are pressed on the dresser board D, and at the same time the dresser board D is fed in the X direction, so that all of the abrasive members 50 are dressed at a time by the dresser board D.

As shown in FIG. 8D, the bottom surface 52 of each abrasive member 50 is dressed by the dresser board D, so that the rounded angular portion 53 between the outer surface 54 and the bottom surface 52 of each abrasive member 50 is sharpened to restore the original shape. Accordingly, the shape of the angular portion 53 between the outer surface 54 and the bottom surface 52 of each abrasive member 50 is corrected to have an acute angle, so that the grinding performance of each abrasive member 50 can be restored. As described above, each abrasive member 50 has such a special shape as of a cutting tool, thereby improving the grinding performance to the resin substrate W as in the case of a cutting tool and also facilitating the shape correction for each abrasive member 50 by the use of the dresser board D.

(Test)

The following test was conducted in such a manner that a workpiece to be evaluated was ground by using the grinding wheel 40 having the abrasive members 50 in the condition where the width of each abrasive member 50 was changed and the number of abrasive members 50 was also changed. Then, the condition of the ground surface of the workpiece was checked. The width of each abrasive member 50 and the number of abrasive members 50 were changed so that the contact area of all the abrasive members 50 to the workpiece was constant. The grinding wheel 40 was prepared by mounting a plurality of metal bond abrasive members 50 having the same grain size on the wheel base 41 having a wheel diameter of 200 mm. As the workpiece to be evaluated, a resin substrate having a size of 130×130 mm was used. The following grinding conditions were set.

Rotational speed of the spindle: 6000 rpm

Work feed speed: 10 mm/second

Number of workpieces: 10

The results of this test were shown in Table below.

| Test No. | Width (mm) | Number of abrasive members | Result |
|---|---|---|---|
| 1 | 2 | 96 | NG |
| 2 | 3 | 72 | OK |
| 3 | 4 | 54 | OK |
| 4 | 4.5 | 48 | Best |
| 5 | 5 | 43 | OK |
| 6 | 6 | 36 | OK |
| 7 | 7 | 31 | OK |
| 8 | 8 | 27 | OK |
| 9 | 9 | 24 | NG |

Figure 9:
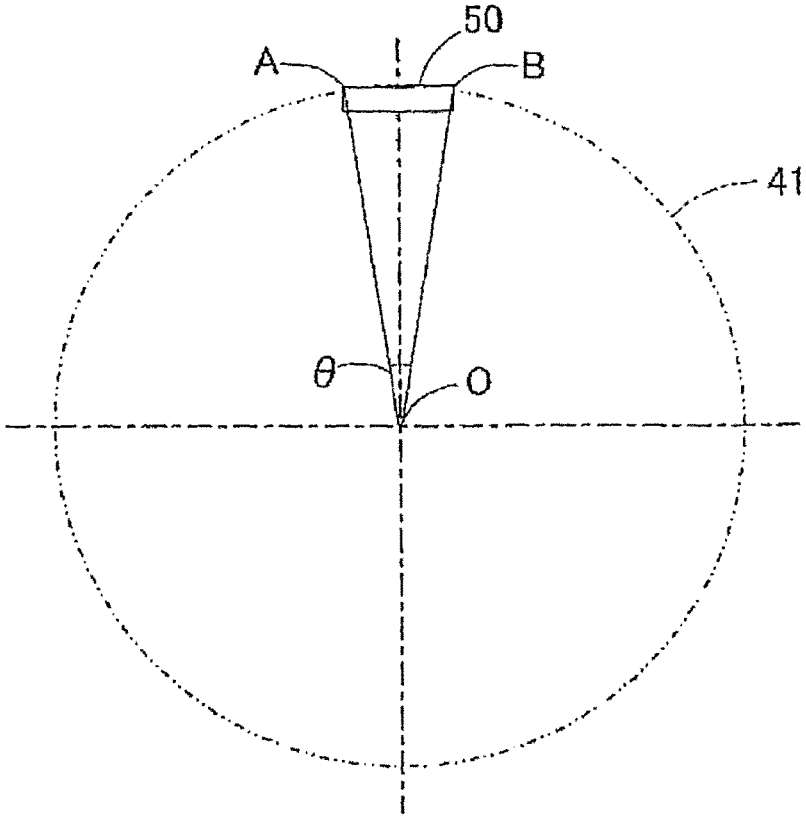
FIG. 9 is a schematic plan view showing the relation between the width of each abrasive member and a wheel base as examined in a test.

In Test No. 1, only the outer surface of each abrasive member contributes to grinding and a slightly rough ground surface was observed on the resin substrate. In Test No. 9, a grinding force is lacking and a rough ground surface was observed on the resin substrate. In Test Nos. 2 to 8, good ground surfaces were observed on the resin substrates. Accordingly, the width of each abrasive member is preferably set to 3 mm to 8 mm, and more preferably 4 mm to 6 mm. In other words, as shown in FIG. 9, reference symbols A and B denote the opposite ends of the width of each abrasive member 50, and reference symbol O denotes the center (rotation axis) of the wheel base 41, wherein the angle θ formed between a line OA connecting the center O and the end A and a line OB connecting the center O and the end B is preferably set to 1.7 degrees to 4.6 degrees, and more preferably 2.3 degrees to 3.4 degrees. In this case, the width of each abrasive member 50 can ensure a sufficient grinding force in the condition where the outer edge of each abrasive member 50 (segment) does not project from the outer circumference of the wheel base 41. In the case of changing the wheel diameter of the wheel base 41 from 200 mm to 100 mm or 300 mm, the best width of each abrasive member 50 was also changed in proportion to this change. It was confirmed that the width of each abrasive member 50 has an effect on the result of grinding. Further, it was confirmed that when the number of abrasive members 50 is increased, the life of each abrasive member 50 is increased and the grinding dust tends to become finer.

As described above, the grinding wheel 40 according to this preferred embodiment includes the plural abrasive members 50, wherein the angle formed by the outer surface 54 with respect to the upper surface (work surface) of the resin substrate W is set as an acute angle, so that each abrasive member 50 is used like a cutting edge. The inclined outer surface 54 of each abrasive member 50 acts on the resin substrate W to grind it, thereby allowing good thinning of the resin substrate W. At this time, the resin substrate W is continuously ground by the plural abrasive members 50, so that the grinding dust becomes fine and the grinding apparatus is therefore not clogged with the grinding dust, thus avoiding drainage trouble. Further, even when the shape of each abrasive member 50 becomes worse during grinding, it can be corrected by the dresser board D. Accordingly, it is not necessary to newly provide any equipment for shape correction of each abrasive member 50, but the shape of each abrasive member 50 can be easily corrected in a short period of time, thereby attaining good economy. Further, since a grinding water is supplied from the plural grinding water supply holes 46 to the plural abrasive members 50 each corresponding thereto, a frictional heat generated from each abrasive member 50 during grinding can be effectively removed.

The present invention is not limited to the above preferred embodiment, but various modifications may be made. In the above preferred embodiment, the size, shape, etc. shown in the attached drawings are merely illustrative and they may be suitably changed within the scope where the effect of the present invention can be exhibited. Further, various modifications may be made without departing from the scope of the object of the present invention.

For example, while each abrasive member 50 is formed as a segment abrasive having a parallelogram shape as viewed in side elevation in the above preferred embodiment, the shape of each abrasive member 50 is not limited. That is, it is only necessary that each abrasive member 50 has the outer surface 54 extending downward from the free end portion 43 of the wheel base 41 so as to be inclined radially outward. For example, each abrasive member 50 may be formed as a segment abrasive having a trapezoidal shape as viewed in side elevation.

Further, while the abrasive feeding means 25 is so configured as to move the grinding means 30 relative to the chuck table 15 toward and away from the chuck table 15 in the abrasive feeding direction (Z direction) in the above preferred embodiment, the configuration of the abrasive feeding means 25 is not limited. That is, it is only necessary that the abrasive feeding means 25 functions to relatively move the grinding means 30 and the chuck table 15 in the abrasive feeding direction. For example, the abrasive feeding means 25 may be configured so as to move the chuck table 15 relative to the grinding means 30 toward and away from the grinding means 30 in the abrasive feeding direction.

Further, while the moving means 20 is so configured as to move the chuck table 15 in its radial direction relative to the grinding means 30 in the above preferred embodiment, the configuration of the moving means 20 is not limited. That is, it is only necessary that the moving means 20 functions to relatively move the grinding means 30 and the chuck table 15 in the radial direction of the chuck table 15. For example, the moving means 20 may be configured so as to move the grinding means 30 relative to the chuck table 15 in its radial direction.

Further, while the grinding wheel 40 is so configured as to be used for creep feed grinding in the above preferred embodiment, the configuration of the grinding wheel 40 is not limited. For example, the grinding wheel 40 may be configured so as to be used for in-feed grinding.

As described above, the present invention has an effect that the shape of each abrasive member to be used as a cutting edge can be easily corrected in a short period of time. In particular, the present invention is useful for a grinding method of grinding a workpiece formed of a tough material such as resin and metal.

The present invention is not limited to the details of the above described preferred embodiment. The scope of the invention is defined by the appended claims and all changes and modifications as fall within the equivalence of the scope of the claims are therefore to be embraced by the invention.

What is claimed is:

1. A grinding wheel for grinding a resin substrate, comprising: a wheel base having a free end portion and a fixed portion to be fixed to a spindle so that the wheel base is rotatable about the spindle and the free end portion of the wheel base has a surface that extends in a plane substantially perpendicular to the longitudinal axis of the spindle; and a plurality of abrasive members fixed to the surface of said free end portion of said wheel base: said wheel base having a plurality of grinding water supply holes for supplying a grinding water to said abrasive members; each abrasive member being formed as a segment abrasive obtained by binding diamond abrasive grains with a metal bond; the shape of each abrasive member being set so that each abrasive member has an outer surface extending downward from the surface of said free end portion of said wheel base so as to be inclined radially outward of said wheel base and each abrasive member has a bottom surface extending substantially parallel to the surface of the free end portion; said plurality of abrasive members being arranged annularly at given intervals; said plurality of grinding water supply holes being formed on said free end portion of said wheel base in the vicinity of said abrasive members so as to each correspond to said abrasive members in the condition where each grinding water supply hole lies on a line connecting the corresponding abrasive member and the axis of rotation of said wheel base.

2. A grinding method of grinding a substrate by using a grinding apparatus including a chuck table for holding said substrate, grinding means having a rotating spindle and a grinding wheel fixed to said rotating spindle for grinding said substrate held on said chuck table, abrasive feeding means for relatively moving said grinding means and said chuck table toward and away from each other in an abrasive feeding direction, and moving means for relatively moving said grinding means and said chuck table in a radial direction of said chuck table; said grinding wheel including: a wheel base having a free end portion and a fixed portion fixed to said rotating spindle; the free end portion of the wheel base has a surface that extends in a plane substantially perpendicular to the longitudinal axis of the spindle; and a plurality of abrasive members fixed to the surface of said free end portion of said wheel base; said wheel base having a plurality of grinding water supply holes for supplying a grinding water to said abrasive members; each abrasive member being formed as a segment abrasive obtained by binding diamond abrasive grains with a metal bond; the shape of each abrasive member being set so that each abrasive member has an outer surface extending downward from the surface of said free end portion of said wheel base so as to be inclined radially outward of said wheel base and each abrasive member has a bottom surface extending substantially parallel to the surface of the free end portion; said plurality of abrasive members being arranged annularly at given intervals; said plurality of grinding water supply holes being formed on said free end portion of said wheel base in the vicinity of said abrasive members so as to each correspond to said abrasive members in the condition where each grinding water supply hole lies on a line connecting the corresponding abrasive member and the axis of rotation of said wheel base; the grinding method comprising grinding said substrate held on said chuck table by creep feed grinding such that said grinding wheel being rotated is horizontally moved relative to said substrate.

* * * * *